United States Patent [19]

Wieckowicz

[11] Patent Number: 5,048,266

[45] Date of Patent: Sep. 17, 1991

[54] BAG FILLING APPARATUS

[75] Inventor: Robert A. Wieckowicz, Rice Lake, Wis.

[73] Assignee: Jerome Foods, Inc., Baron, Wis.

[21] Appl. No.: 472,093

[22] Filed: Jan. 30, 1990

[51] Int. Cl.[5] ..... B65B 43/36; B65B 45/00; B65B 57/02

[52] U.S. Cl. ..... 53/469; 53/385.1; 53/506; 53/571; 53/390

[58] Field of Search ..... 53/469, 468, 570, 571, 53/572, 573, 385, 384, 386, 381 R, 505, 506, 390; 141/316, 114, 10, 313

[56] References Cited

U.S. PATENT DOCUMENTS

| | | | |
|---|---|---|---|
| 2,899,788 | 6/1955 | Beebe | 53/570 X |
| 3,347,156 | 10/1967 | Stock | 100/7 |
| 3,432,982 | 9/1965 | Brinkmeier et al. . | |
| 3,455,088 | 7/1969 | Lerner | 53/570 X |
| 3,646,726 | 3/1972 | Hutcheson | 53/469 X |
| 3,807,122 | 4/1974 | Kihnke et al. | 53/506 X |
| 3,830,266 | 8/1974 | Hudson | 141/10 |
| 3,864,894 | 2/1975 | Sheetz et al. | 53/506 |
| 3,988,873 | 11/1976 | Oliverius | 53/469 X |
| 4,078,358 | 3/1978 | Henderson | 53/573 X |
| 4,241,562 | 12/1980 | Meyer | 53/571 X |
| 4,248,278 | 2/1981 | Blodgett | 141/316 |
| 4,494,364 | 1/1985 | Meyn | 53/570 |
| 4,549,387 | 10/1985 | Marshall et al. | 53/469 |
| 4,736,572 | 4/1988 | Fang et al. | 53/512 |

*Primary Examiner*—James F. Coan

*Attorney, Agent, or Firm*—Gregory P. Kaihoi; Edward S. Hotchkiss

[57] ABSTRACT

An apparatus and method for filling a bag with a commodity without contaminating a sealable region of the bag near its opening. The apparatus includes a mechanism for forming a cuff in the bag and holding the bag as it is being filled. A frame associated with the cuffing mechanism assists in positioning the commodity adjacent the cuffed bag and for facilitating insertion of the commodity into the bag. Desirably the frame includes a platform on which the commodity may be prepared prior to insertion of it into the bag. Preferably the platform is movable between a first position oriented to facilitate preparation of the commodity and a second position oriented to facilitate insertion of the commodity into the bag. The device and method is particularly useful in packaging commodities which may be emulsion-laden, including meats such as poultry.

19 Claims, 12 Drawing Sheets

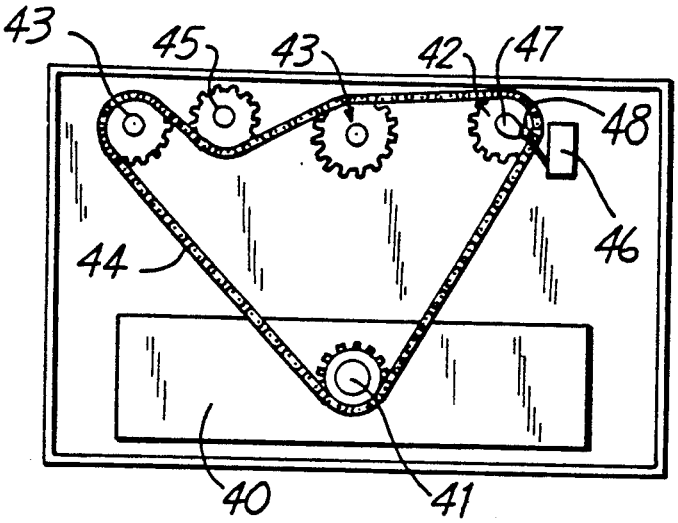
Fig. 3
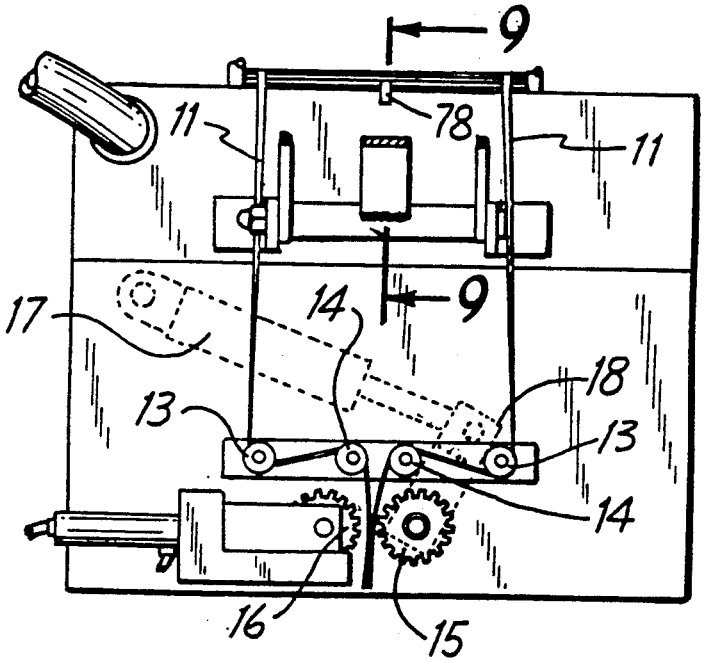
Fig. 4
Fig. 5
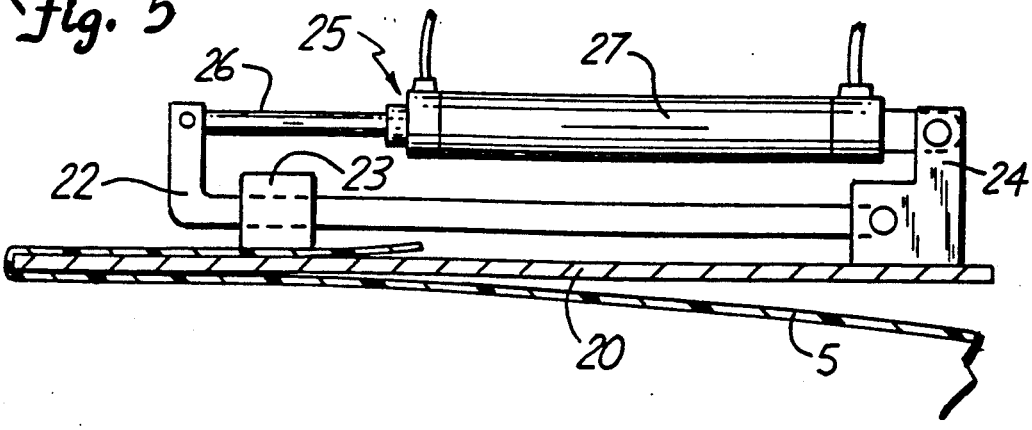

BAG FILLING APPARATUS

FIELD OF THE INVENTION

The invention relates to apparatus and methods for filling containers with a commodity, and in particular methods and apparatus for filling containers with emulsion-laden commodities such as fresh poultry into heat sealable bags.

BACKGROUND OF THE INVENTION

Although the packaging of many types of commodities and food products has been highly automated, packaging of some commodities is yet fairly labor intensive. Moreover, many of these processes give rise to significant waste.

By way of example, in a common method for packaging turkey roasts, three whole muscle turkey breasts are manually arranged to gain the desired muscle alignment and then stuffed into a transparent bag by a worker. The mouth of the bag then is manually twisted and clamped shut with a mechanical fastener. The region of the bag adjacent the bag opening inherently comes into contact with the emulsion-laden turkey pieces as they are inserted into the bag. This contamination of the bag opening makes it very difficult, if not impossible, to heat seal the bag—many heat sealing machines are capable of sealing bags that are merely wet, but the emulsion on the bag is particularly difficult in that it may both foul the actual seal and it may contaminate the sealing device surfaces, building up a residue that prevents the machine from working properly. Thus, such emulsion laden bags typically are fastened with a metal or similar mechanical fastening device, which does not produce a moisture-tight closure.

Turkey roasts of the type just described often (though not necessarily) are pre-cooked in these packaged bags. Because the mechanical-type closure is not moisture tight, and because the manual packaging process makes it difficult to evacuate all air pockets, the bags typically include small perforations uniformly distributed about the bag to permit trapped air to escape during the roasting process. These holes also permit the natural juices to escape, however, both before, during, and after the cooking process. Moreover, the manual packaging of such roasts inevitably leads to waste in the loss of small pieces of meat and of juices, and is physically difficult due to the laborious and repetitive motions involved in tightly stuffing the muscles and manually expelling as much air as is reasonably possible.

SUMMARY OF THE INVENTION

The invention, in one embodiment, relates to an apparatus for filling a bag with a commodity, particularly a meat product where muscle alignment is desired such as whole turkey breasts, without contaminating the sealable region of the bag adjacent its opening. The apparatus includes a cuffing mechanism for forming a cuff at the opening of the bag, and platform means associated with the cuffing means for positioning the commodity adjacent to the cuffed bag and for facilitating insertion of the commodity into the bag.

Desirably, the platform is moveable between a first position, oriented to facilitate preparation of the commodity (such as muscle alignment), and a second position oriented to facilitate insertion of the commodity into the bag. Preferably the platform includes means defining a funnel-like opening being closely receivable in the mouth of the cuffed bag. Thus, when the commodity has been suitably arranged and prepared, the platform is tilted toward the bag opening, the funnel-like opening of the platform being inserted into the mouth of the cuffed bag, and the commodity then inserted into the bag. In this way, the apparatus prevents contamination of the cuffed portion of the bag, permitting subsequent vacuum packaging/heat sealing of the bag. Because excess air can be evacuated from the bag just prior to heat sealing, and because heat sealing provides a moisture-tight seal, the commodity—such as turkey—can be cooked and/or stored in the bag without any loss of natural juices.

In another embodiment, the invention relates to a method of filling a bag, having an opening therein, with a commodity without contaminating a sealable region of the bag adjacent to the opening. The method includes the steps of forming a cuff in the sealable region of the bag adjacent to the opening, arranging the commodity on a platform adjacent to the bag, the platform including funnel means defining a funnel-like opening being closely receivable in the cuffed bag opening, and inserting the platform funnel means into the bag opening to permit the commodity to be inserted into the bag. Subsequently the bag is uncuffed, and the uncontaminated sealable region can be heat sealed. If desired, the bag can be evacuated of air just prior to heat sealing.

BRIEF DESCRIPTION OF THE DRAWINGS

FIG. 3 is a somewhat schematic view of a preferred means of driving the cuffing arms of the device of FIG. 1;

FIG. 4 is a broken-away view of FIG. 1 taken along line 4—4 thereof;

FIG. 5 is a broken-away view of the clamp portion of a cuffing mechanism according to the invention;

DETAILED DESCRIPTION OF THE INVENTION

The invention, in one embodiment, comprises an apparatus for filling a bag with a commodity, such as turkey breasts or other types of meat or poultry where positioning or muscle alignment of the commodity is important. The apparatus ensures that the commodity does not contact a sealable region of the bag adjacent its opening. The bag then can be heat-sealed using conventional heat sealing devices. Heat sealing would not be possible if the area to be sealed had been contaminated by the product, particularly if the contamination includes an emulsion of the type common in poultry and other meat products.

Figure 1:
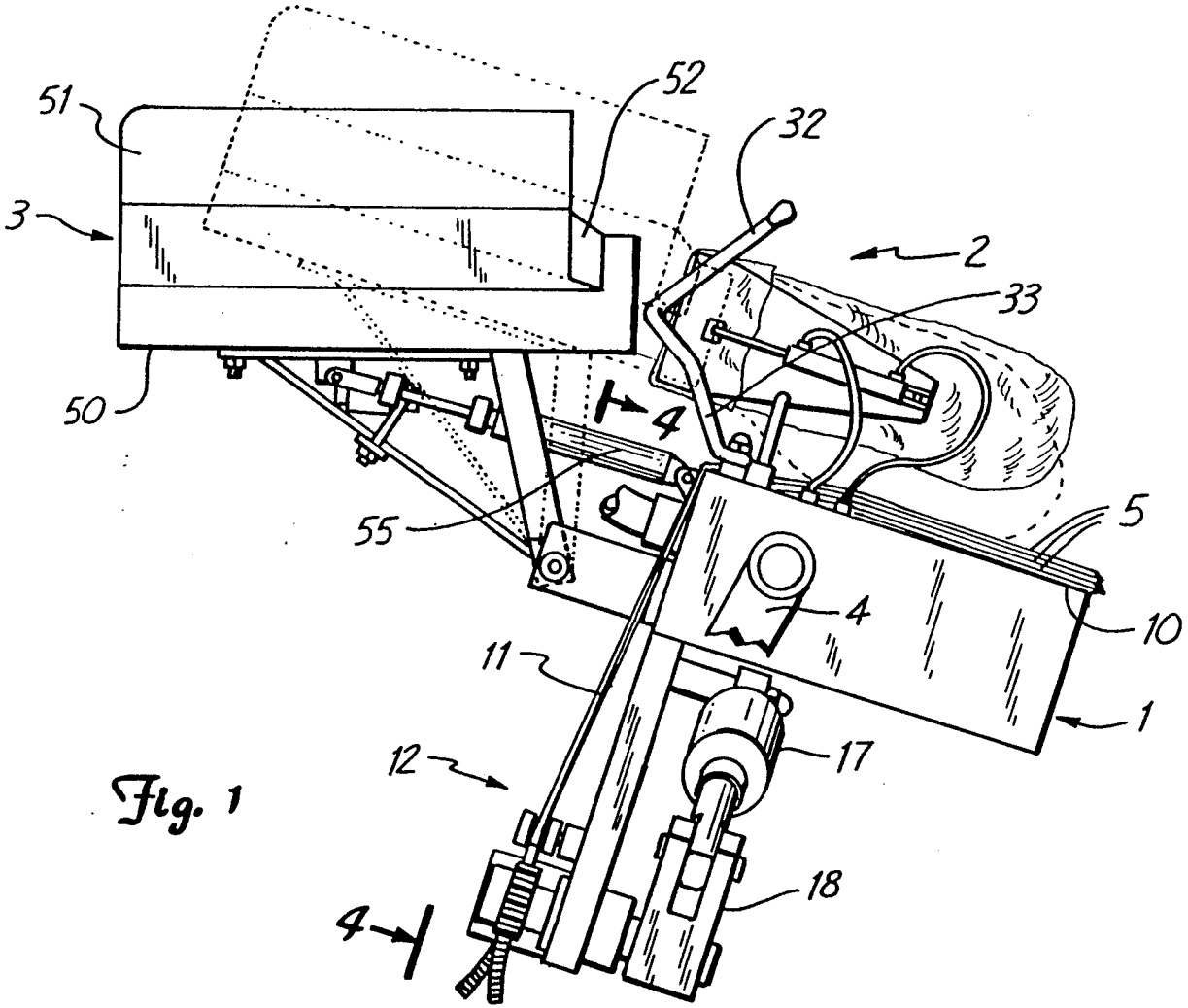
FIG. 1 is a side elevation view of a bag filling device according to the invention.

The drawings depict a preferred embodiment of the invention. Referring first to FIG. 1, the bagging apparatus generally includes a frame (1) supported by legs (4), bag positioning means (2), and platform means comprising a horn (3) for holding the commodity to be bagged.

The frame (1) includes an upper surface (10) on which a series of bags (5) may be carried. In a preferred embodiment, bags (5) to be filled are removably attached in series to a carrying tape (11), such as is commercially available, so that each bag (5) may be individually detached from the tape (11). The bags rest on the upper surface (10) of the frame (1) and the carrying tape (11) leads from the frame to the bag advancing means (12). As best seen in the preferred embodiment of FIG. 4, such advancing means may include first and second pairs of guide rollers (13 and 14, respectively) through which the tape (11) is threaded. The tape (11) then passes through a pair of advancing gears (15,16) (shown in the open position), desirably with the adhesive sides of the tape facing one another. The driving gear (15) is rotatably attached to the frame (1) and a friction gear (16) is slidable between a position disposed away from the drive gear (as shown), and a position wherein it contacts the drive gear, pinching the tape (11) therebetween. When bags (5) have been loaded onto the frame and the tape (11) has been threaded in appropriate fashion, the friction gear (16) is brought into contact with the drive gear (15) and the drive gear can then be rotated, pulling the tape (5) and thereby advancing a bag on the frame the desired distance.

The drive gear (15) may be driven in any conventional manner. In a preferred embodiment, the gear is rotatable in only one direction, being attached in rachet fashion or by conventional roller clutches to a drive lever (18). The drive lever (18) in turn is rotatably attached to a drive piston (17). When the system is energized, the drive piston (17) will continuously reciprocate the lever (18), causing the gear (15) to rotate (the rachet or roller clutch preventing the gear from rotating backwards), thereby advancing the empty bags (5).

The bags are advanced until the uppermost bag (5) is detected as being in the desired position. In a preferred embodiment, when the bag (5) has advanced the desired distance it blocks a position sensing air jet (75) (which will be explained below in connection with FIGS. 6 and 9), causing the drive piston (17) to pause. When that bag (5) is cuffed by the cuffing mechanism, it is removed from its position blocking the position sensing air jet (75), allowing the piston to begin reciprocating again to advance the next bag (5) into position. In this way the mechanism insures that a bag (5) is always present in the correct position for the cuffing operation, as explained below.

Figure 2B:
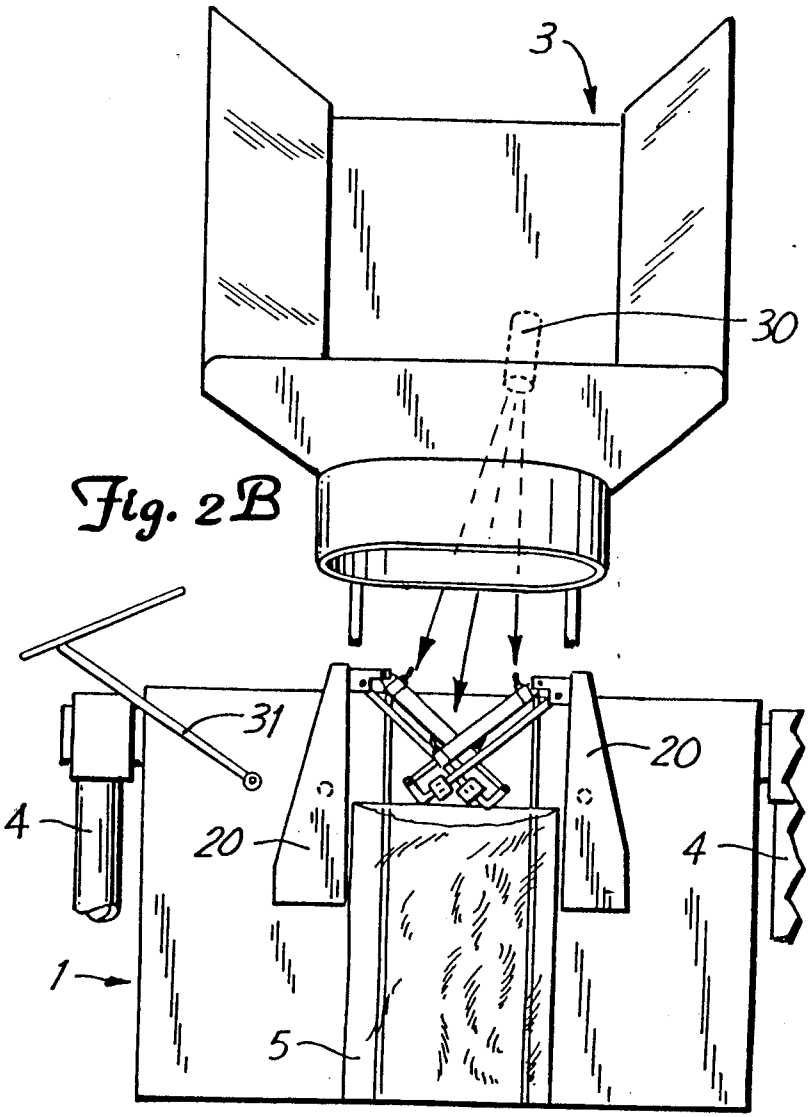
FIGS. 2A–I are top, partially broken-away views of a bag filling device similar to the one depicted in FIG. 1, showing a preferred operational sequence.
Figure 2A:
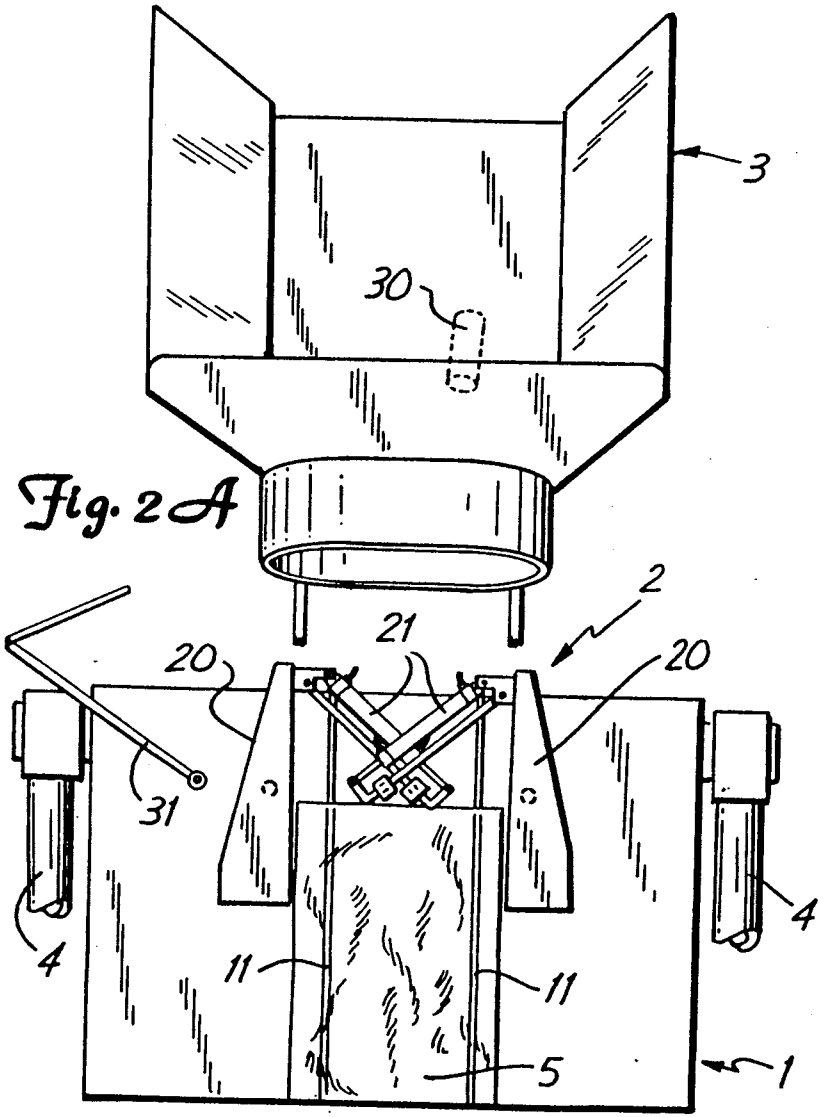

FIG. 2A shows an empty bag (5) positioned for filling on the frame (1) between two cuffing arms (20). (The relative position of the bag (5) with respect to the frame (1) is slightly different in FIGS. 2A–2I than in FIGS. 1, 4 and 9. The position of the bag (5) is determined by placement of the bag position sensor, not shown in FIGS. 2A–2I for the sake of clarity.) Each cuffing arm desirably comprises a curved member, pivotally mounted above the frame, which may be tapered from a point near its forward end toward its rear end. A retaining clamp (21) is pivotally mounted on each cuffing arm (20) at a point disposed toward the forward end of said cuffing arm.

A preferred embodiment of the retaining clamp (21) is shown in greater detail in FIG. 5. The retaining clamp (21) includes an inner arm (22) on which a retaining pad (23), which may be made of urethane or a like material, is attached at a position disposed away from the mounting bracket (24). The mounting bracket is secured to the cuffing arm (20), and the inner arm (22) is rotatably attached to said mounting bracket (24). The retaining clamp (21) also includes an outer arm (25) which comprises a movable rod (26) with one end slidably disposed in a piston (27). This outer arm is pivotally attached at one end to the mounting bracket (24) and at the other end to the inner arm (22). The length of the outer arm (25) can be varied by sliding the movable rod (26) within the piston (27), for example by pneumatic pressure. This change in length causes the retaining clamp (21) to pivot about the mounting bracket (24) from the position shown in FIG. 2A to the position shown in FIG. 2C.

Once a bag (5) is positioned generally as shown in FIG. 2A, the bag is opened, preferably by a blast of air from a bag inflating nozzle (30) directed at the open end of the bag (5), lifting a portion of the bag up between the cuffing arms (20). The retaining clamps (21) then may be rotated into the mouth of the opened bag (5) and into contact with their respective cuffing arms (20), pinning the wall of the bag (5) between the retaining pads (23) and the cuffing arms (20), as shown in FIG. 2C.

Figure 2D:
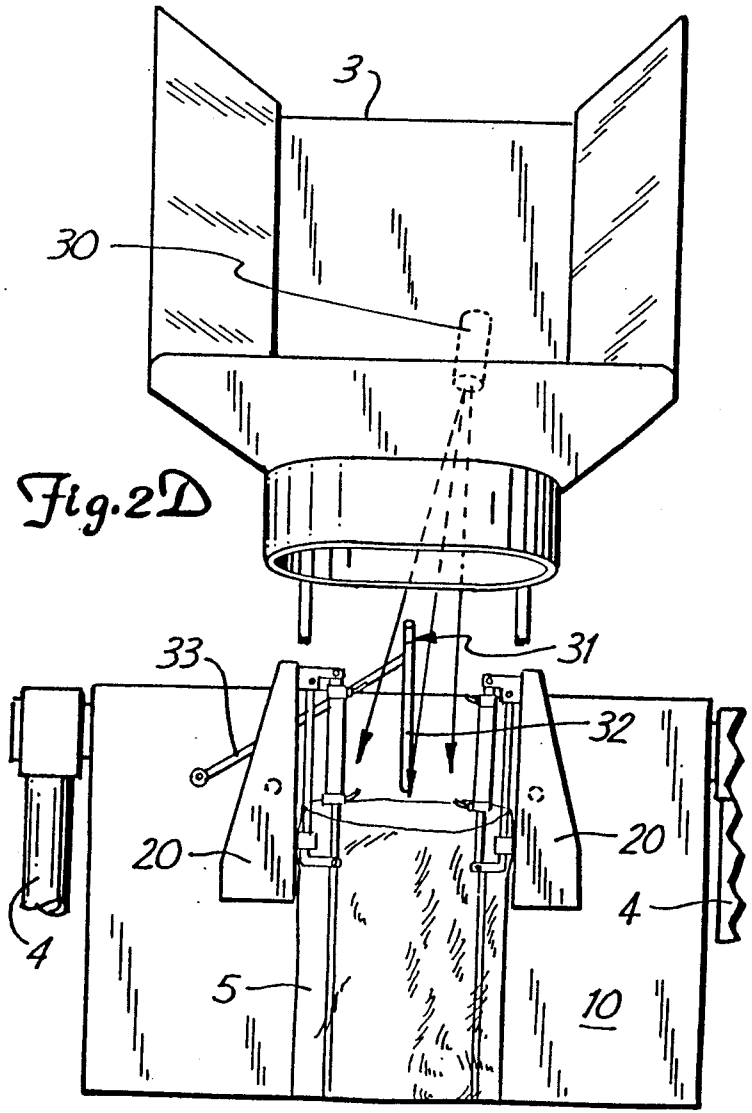
Figure 2C:
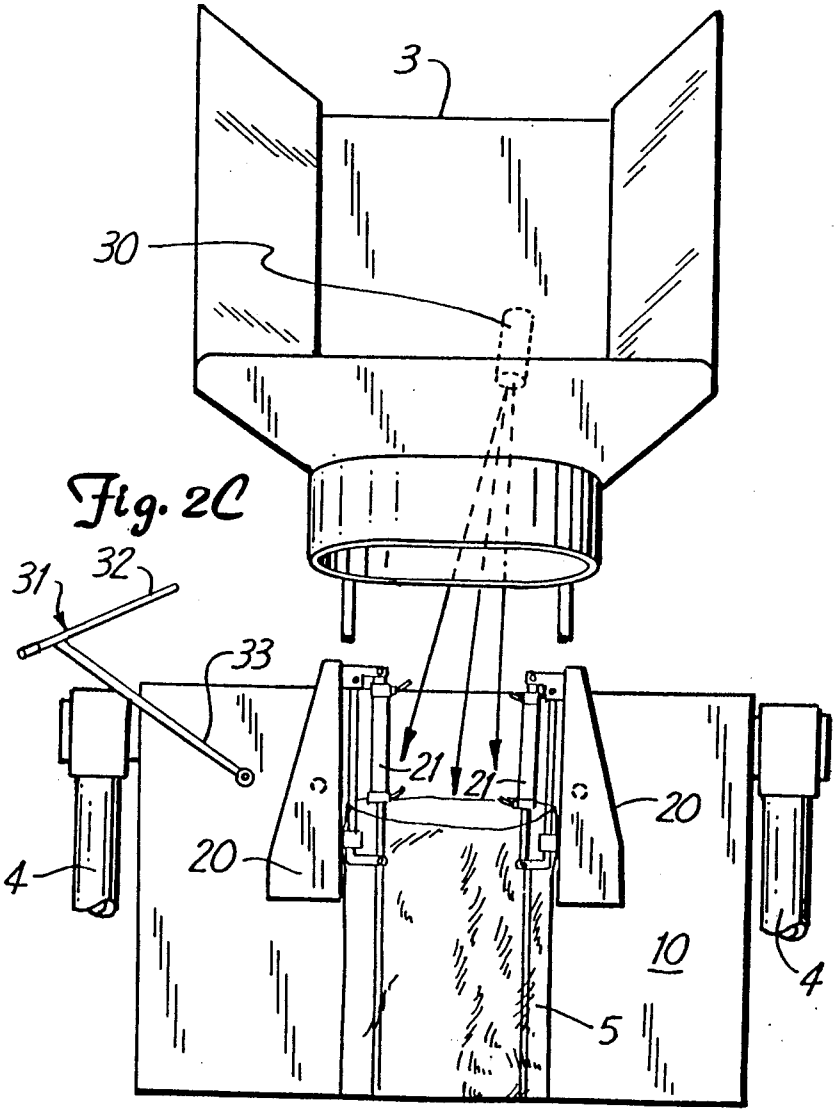

Preferably, a tucking arm (31) is then rotated between a first position disposed away from the mouth of the open bag (as in FIG. 2C) to a position disposed substantially in front of the open bag and between the cuffing arms (as in FIG. 2D). The tucking arm (31) desirably comprises a generally V-shaped portion (32), the point of which is disposed into the open end of the bag in the arm s second position (FIG. 2D). The V-shaped portion is carried by a mounting member (33) which is rotatably attached to the frame (1). Once the tucking arm is in its second position, the air flow through the bag inflating nozzle (30) is terminated.

Figure 2E:
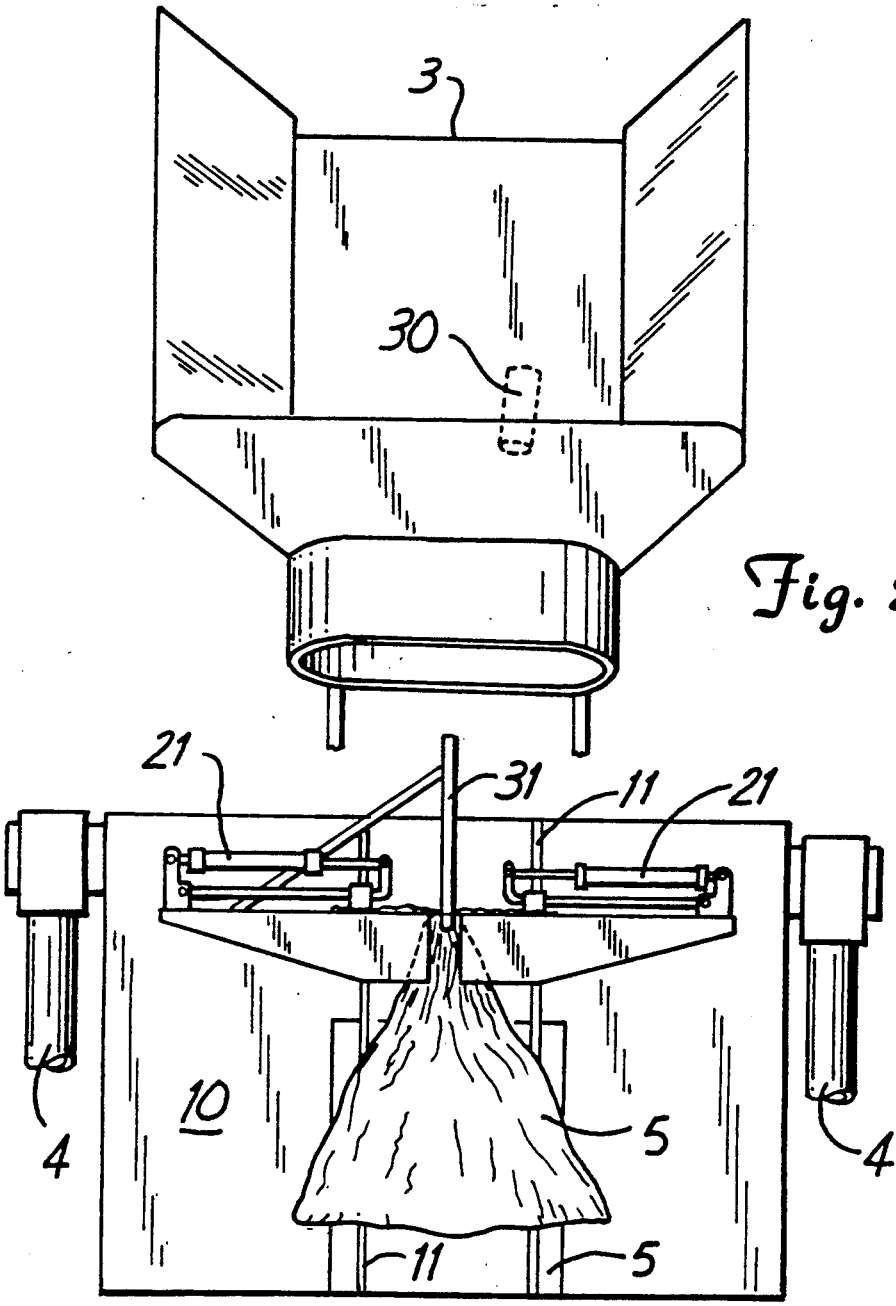
Figure 2G:
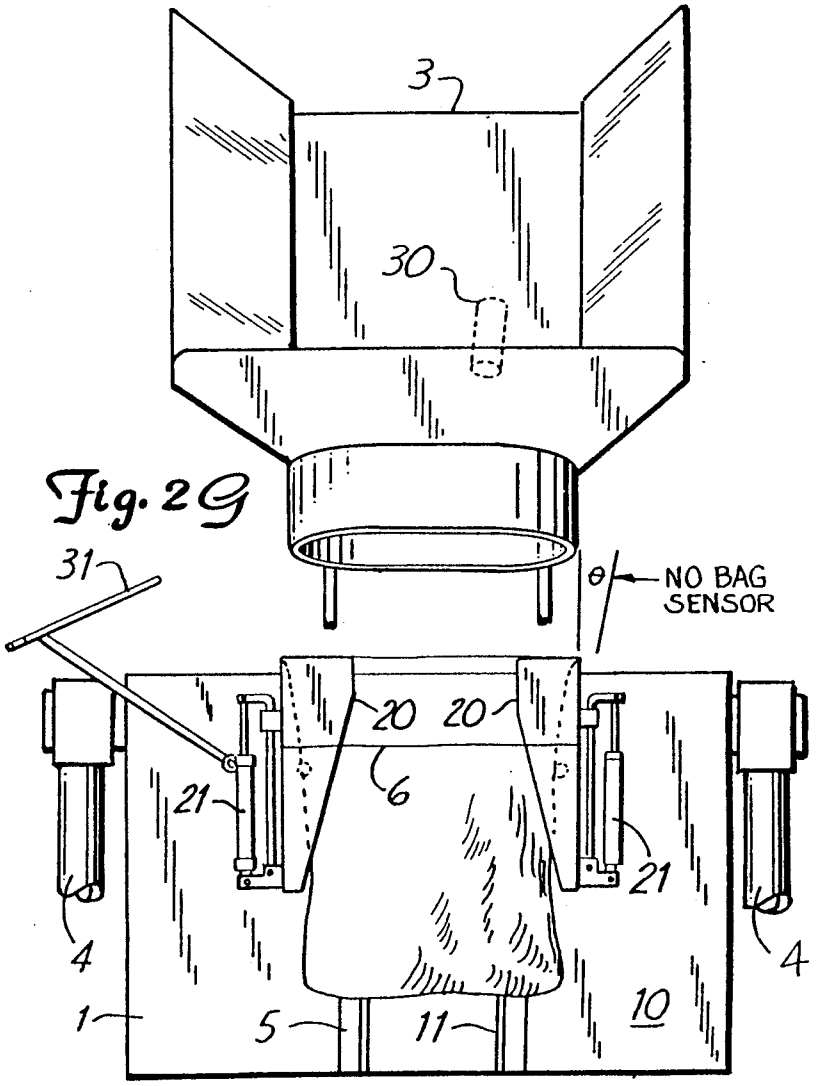
Figure 2F:
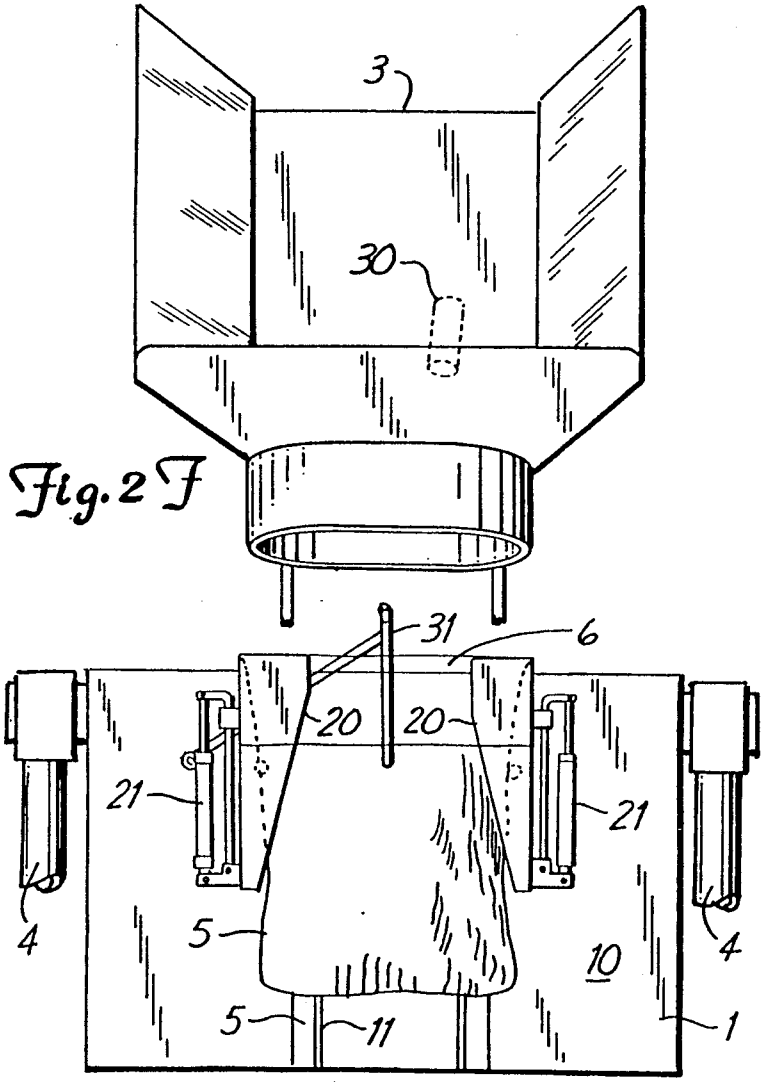
Figure 2J:
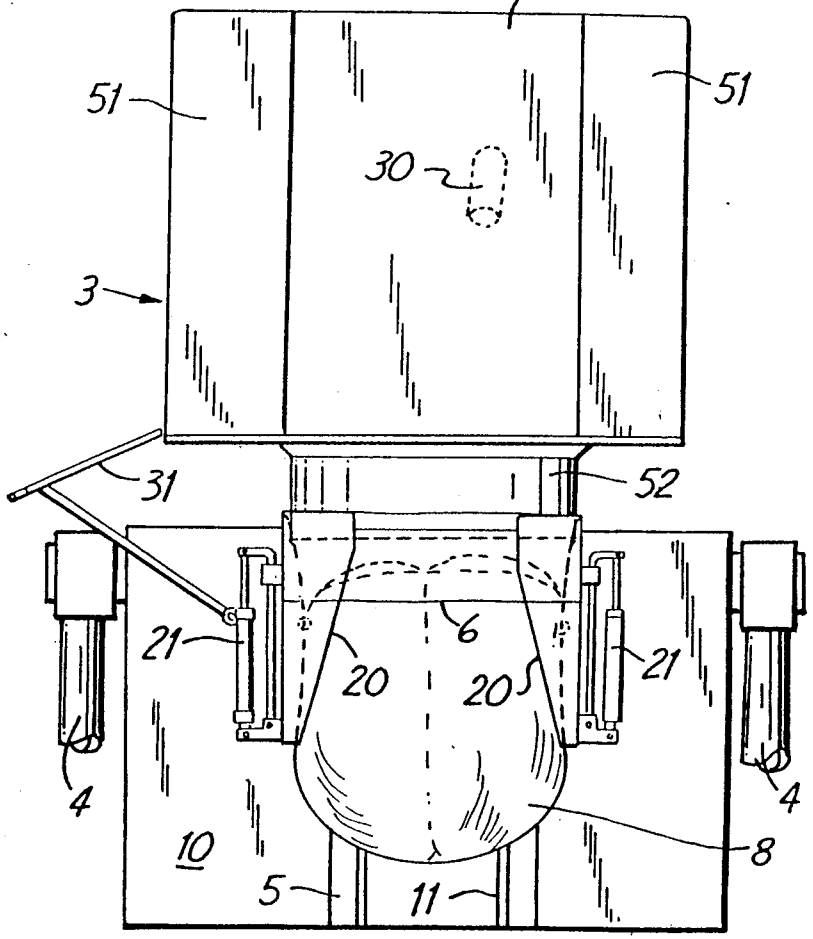
Figure 2H:
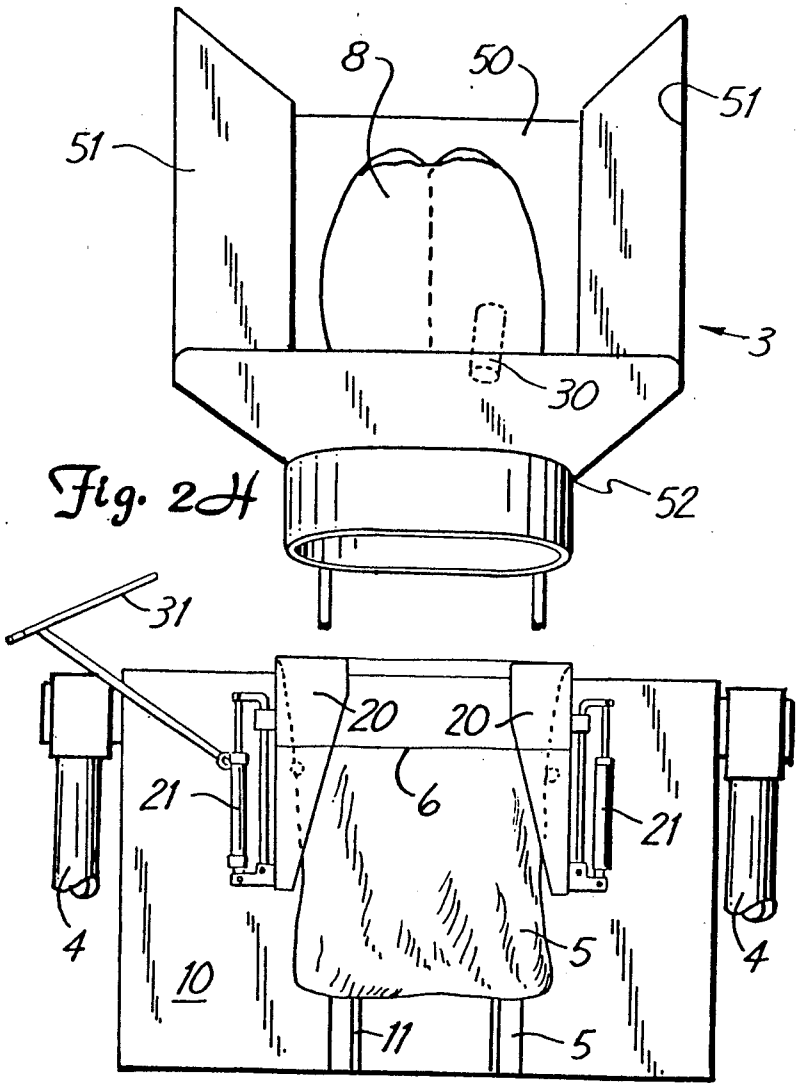

The cuffing arms (20) are then rotated in opposite directions, pulling the bag (5) forward toward the tucking arm (31), until the two cuffing arms (20) are in a position wherein their convex faces substantially face one another, as in FIG. 2E. (Referring to FIGS. 2D–2F, the left cuffing arm rotates counterclockwise, while the right cuffing arm rotates clockwise.) As the cuffing arms (20) so rotate, an area of the bag adjacent its opening contacts the V-shaped portion of the tucking arm (32), and the opposite faces of the bag are forced away from one another and over the end of the cuffing arms. As shown in FIG. 2E, the cuffing arms ar desirably positioned such that they pass close to the tucking arm as they rotate to ensure that the bag rides along the V-shaped portion of the tucking arm. In this manner, the bag to be filled is placed in a position for filling with a cuff (6) formed adjacent the opening of the bag, as shown in FIG. 2F. The tucking arm (31) is then rotated to its first position disposed away from the opening of the bag (FIG. 2G).

A preferred apparatus for rotating the cuffing arms is shown in FIG. 3 as viewed from the underside of the frame (1). The apparatus includes a reversible motor (40), attached to a drive gear (41), capable of rotating said gear in either a clockwise or counterclockwise direction. The apparatus also includes a pair of idler gears (43) and one driven gear connected to each of the cuffing arms (42,45). A drive chain (44) is threaded among all five of these gears such as is shown in FIG. 3. By passing the drive chain on one side of the first cuffing arm gear (42) and on the opposite side of the second cuffing arm gear (45), the cuffing arms will rotate in opposite directions while being simultaneously driven by the same motor and drive gear combination.

Referring to FIG. 1, it can be seen that the platform means, which in a preferred embodiment comprises a horn (3), is attached to the frame in such a way as to allow it to be moved from a first position, wherein the bottom of the horn is essentially horizontal (shown by solid lines in FIG. 1), to a second position wherein the horn is tilted at a forward angle (shown by phantom lines in FIG. 1). In order to ensure that the horn is not tilted into the forward position when an empty bag is not ready to receive the commodity, the bag positioning means (2) includes a no-bag sensor (46 in FIG. 3). In a preferred embodiment, one of the driven gears (42) attached to a cuffing arm includes a cam (47) which includes a rounded protrusion. The no-bag sensor includes a roller arm (48) which rides along the eccentric portion of the cam (47). As the driven gear (47) rotates, the roller arm (48) pivots, following the contour of the cam (47). The cam is desirably positioned such that when the roller arm contacts the high point of the cam (i.e., that portion of the cam farthest away from the axis of the gear), the cuffing arm is in a position which indicates that a bag has been properly cuffed. When the roller arm reaches this position, the horn may be unlocked and tilted toward the bag (i.e., air cylinder (55) is depressurized, allowing the operator to tilt the horn (3)).

If a bag is not present when the cuffing arms rotate, however, the cuffing arms (20) will not meet resistance to further movement caused by tension in the cuff of the bag. Instead, they will rotate through a further angle (theta in FIG. 2G) and the roller arm (48) of the no-bag sensor will pass the high point of the cam (47). When this occurs, the horn will be pneumatically locked (i.e., air cylinder (55) is pressurized in its extended position) to prevent it from tilting forward, thereby avoiding inadvertent loss of the commodity by attempting to fill a bag which is not present.

The platform means may be made in any suitable shape for receiving, forming and loading the product. In a preferred embodiment, the platform means comprises a horn (3) which includes a substantially flat stage (50) which is preferably generally horizontal when the horn (3) is in its first horizontal position. The product may be placed in the horn by an operator or, if preferred, may be deposited there by automated means. If any manual manipulation of the commodity is to be done before bagging, such as shaping boneless turkey breast pieces into a whole roast shape with the muscle portions properly aligned, this operation may be performed on this stage. If so desired, the horn may be designed with elevated side walls (51) to help position the product on the stage and ensure that no product is accidentally lost over the sides.

The horn (3) may also include a forward funnel-shaped portion (17) which tapers to a size slightly less than that of the bag opening defined by the bag (5) and the cuffing arms (20). In this configuration, when the frame is in its tilted, forward position (FIG. 2I), the funnel-shaped portion protrudes into the bag opening so the product may be loaded into the bag through the funnel portion while avoiding any contact between the product (8) and the cuff of the bag (6). The commodity may be moved through the funnel portion manually by an operator or via an automated mechanism, such as a piston which slides along the frame pushing the product through the funnel (not shown). After the product is placed in the bag, the horn is desirably tilted back to its first position away from the bag (as in FIG. 2H).

As mentioned above, the platform means is movable between a first, generally horizontal position (FIG. 2H) for receiving and forming the product, and a second, forwardly tilted position (FIG. 2I) for loading the product into the bag. The movement between these two positions may be accomplished manually or in any other desired fashion. In a preferred embodiment, an air cylinder (55) is provided between the frame (I) and the platform. The movement of this air cylinder (55) between a first position wherein the platform is horizontal and a second position wherein the platform is forwardly tilted, can be activated by a signal from the operator, such as by pressing a foot switch. By utilizing a mechanical, rather than manual, means, one can ensure that the platform will not be tilted forward if the no-bag sensor (described hereinabove) indicates that a bag is not ready to receive the product. Preferably, unless the no-bag sensor confirms the presence of a properly cuffed bag, air pressure is maintained in the air cylinder (55) with the platform in its horizontal position, preventing movement of the piston. When the sensor indicates that a bag is present, the air cylinder is depressurized, allowing the horn (3) to be tilted to insert the product in the bag.

After the product has been placed in the bag, the platform is returned to its first horizontal position. The cuffing arms (20) may then be rotated back to their original position (shown in FIG. 2A) and the retaining clamps (21) are returned to their initial positions, disposed away from their respective cuffing arms. This releases the product-filled bag, which bag can then be removed from the frame for further processing, such as sealing. In a preferred embodiment, the platform (10) is angled downwardly, which allows the filled bag to freely slide away from the cuffing arms, facilitating removal. The bag advancing means (12) may then advance the next bag into position to be inflated, cuffed, and filled as described above.

A bag filled by this apparatus may be sealed in any desired fashion. However, bags filled on this apparatus are ideally suited for heat-sealing because the apparatus ensures that both the interior and exterior surfaces of a portion of the bag adjacent its opening remain free from any contamination by the product. Heat sealing may be accomplished by any of the methods known in the art. Preferably, the bags are evacuated of air prior to heat-sealing This method is particularly well suited for bagging products such as shaped boneless turkey breasts which are then to be cooked, because heat-sealing ensures that no product will be lost prior to or during the cooking procedure; removal of air from the bag prior to sealing avoids rupturing of the bag due to expansion of trapped air during the cooking process.

In a preferred embodiment of the bagging apparatus of this invention, the primary operations of the device are pneumatically controlled. Routine cleaning of food handling equipment of this type often involves the use of lots of water and cleaning agents that are hard on electrical components. Thus, pneumatic control and power for the invention is uniquely well suited for this environment.

Figure 6A:
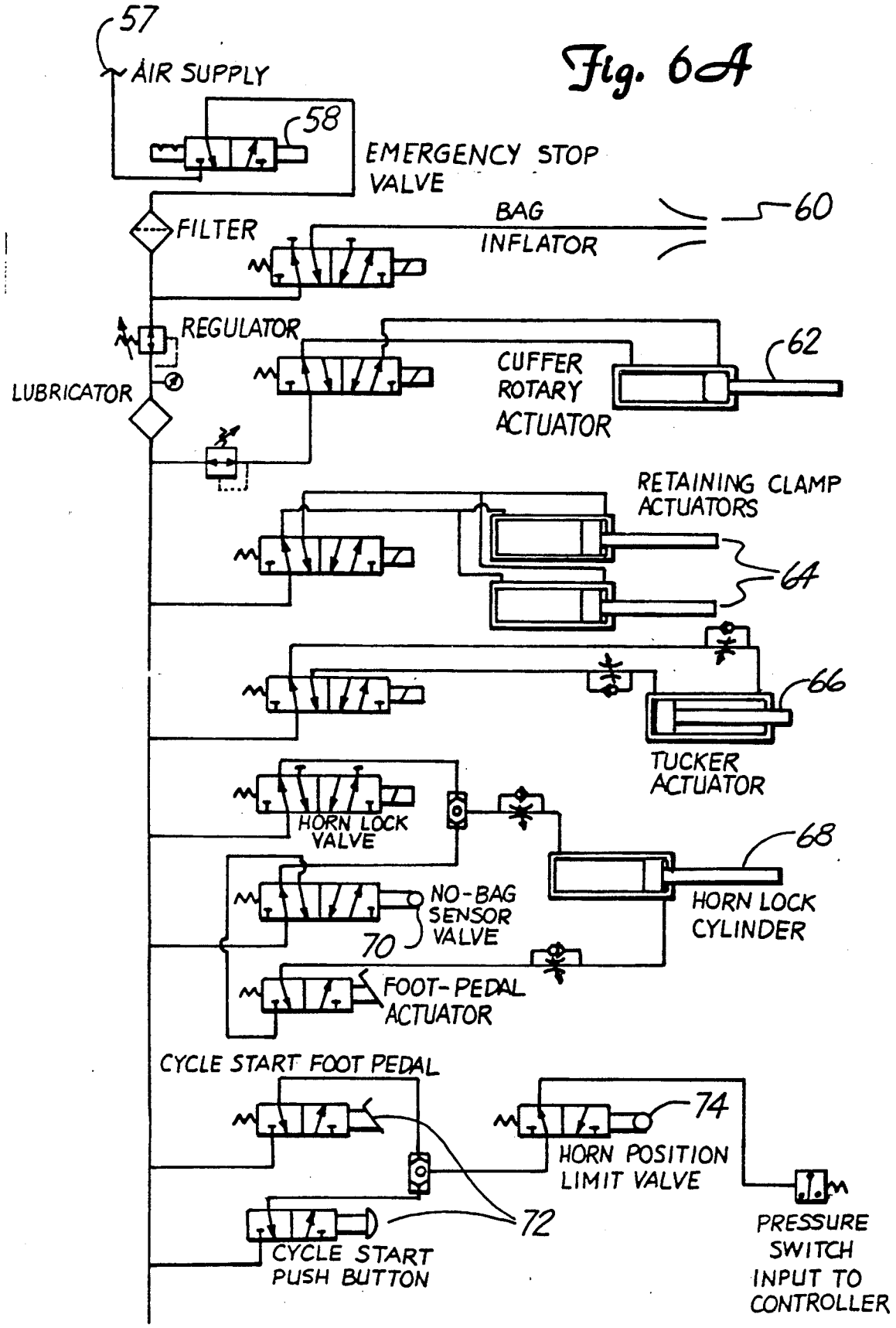
FIG. 6A and B are a schematic diagram of the pneumatic power system of the device of FIG. 1.

FIGS. 6A and B depict an air logic/power diagram (employing standard ANSI schematics) for such a pneumatically controlled embodiment. Compressed air enters the system at the air inlet (57) and first encounters an emergency stop valve (58). As long as the emergency stop has not been shut off, the air passes into the rest of the system. This pressurized air is provided to the various air cylinders and other components through various valves, some of which are solenoid controlled, other of which are manually controlled by the operator, and others of which are mechanically controlled in response to cam followers and the like. The solenoid controlled valves in turn are controlled by a suitable electronic logic controller (not shown for the sake of clarity), which operates the valves in accordance with the general schematic shown in FIGS. 7–8.

The cuffing drive gear actuator (62) provides the motive force for driving the cuffing arms (20) between their cuffed and uncuffed positions. As described above, the retaining clamps (21) include a piston for rotating the clamps between engagement and disengagement with their respective cuffing arm, and this piston may also be controlled pneumatically (64). The tucking arm (31) may be driven between its first position, disposed away from the cuffing arms to a second position, wherein the tucking arm engages an area of the bag adjacent its opening during the cuffing operation, by a tucking arm actuator (66).

The platform positioning air cylinder (55) may be pneumatically controlled as shown in FIG. FIG. 6A (68) such that the cylinder will not move the platform from its substantially horizontal position (which piston position is shown in FIG. 6A), unless the no-bag sensor (70) indicates that a bag is present and properly cuffed.

In response to the operator depressing the cycle start button (72), the cuffing process is initiated. The cycle start button may be either a hand-pressed button or a foot pedal or, if desired, both may be included, as shown. The air control system also includes a platform position limit valve (74) to ensure that the automatic motion of the cuffing arms (20), retaining clamps (21) and tucker arm (31) cannot be initiated unless the platform (horn) is in the retracted position to prevent injury to the operator, product, or package.

Figure 6B:
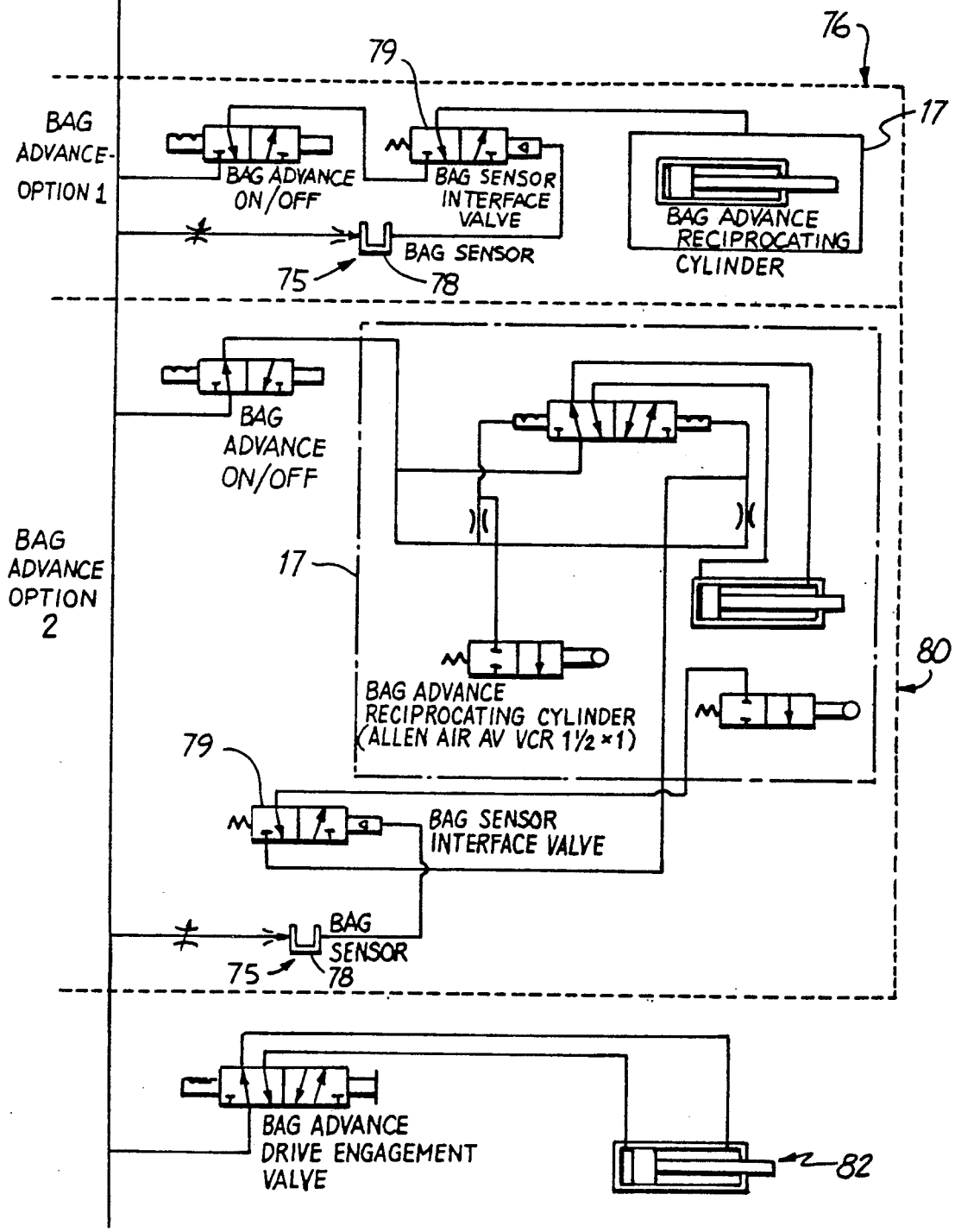

The bag advancing means (12) may be controlled via either of two options designated as (76, 80) in FIG. 6B. Both of these options preferably include a bag position sensing air jet (75) which desirably includes a bracket (78) with a pressurized air supply nozzle (84) on one side (the left side in the schematic) and an air receiving port (85) disposed opposite the nozzle (84). As long as a stream of air continues to pass from the nozzle (84) to the receiving port (85), pressurized air is supplied to the drive piston (17) which is desirably a commercially available, continuously reciprocating cylinder. The drive lever (18 in FIG. 4) may be attached to the drive gear (15 in FIG. 4) via an overrunning clutch mechanism to ensure that the drive gear only rotates in one direction (counterclockwise in FIG. 4).

Figure 9:
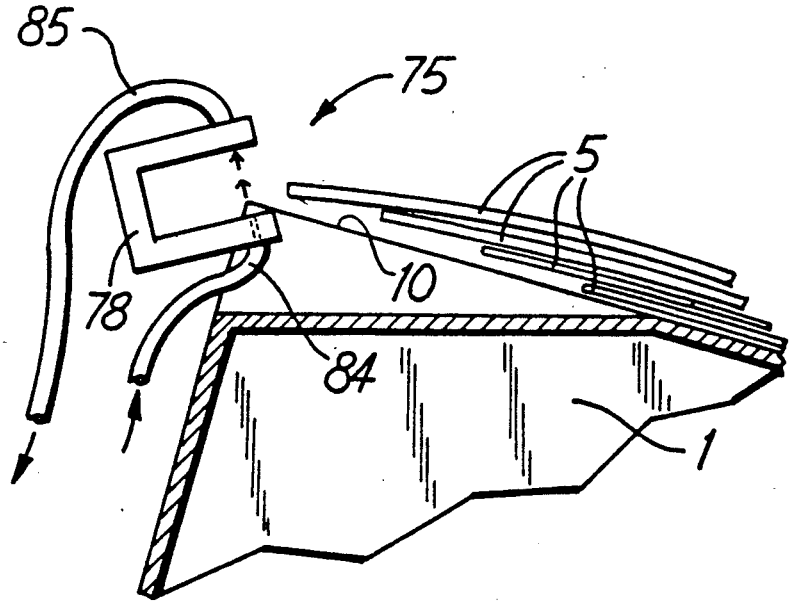
FIG. 9 is a broken-away view of a bag position sensor of the invention, taken along line 9—9 of FIG. 4.

In an environment such as found in a poultry processing plant the device of the invention is prone to become soiled with poultry emulsion, pieces of meat, and other contaminants. The bag position sensor (75) is particularly suitable for operation in this environment. Whereas micro-switches or hair triggers would be prone to erroneously indicate a bag was in position when engaged by a stray piece of meat or emulsion, the bag position sensor of the invention generally avoids such errors. As positioned in FIG. 9, the bracket (78) shelters the air stream from most contaminants. Moreover, placing the air supply nozzle (84) at the bottom shooting upwardly into a top mounted receiving port (85) (as shown in FIG. 9) renders the unit self cleaning of most minor contaminants.

Referring to FIG. 6B, when a bag passes between the air supply nozzle (84) and the receiving port (85) of the bracket (78), the flow of air between these two members is interrupted, causing a pneumatic valve (79) to close off the air supply to the drive lever (17). In the first optional configuration (depicted within the broken lines indicated by (76) in FIG. 6B), this causes the drive lever to immediately stop moving, leaving the bag in position for inflation and cuffing. In the second option (depicted within the broken lines indicated by (80) in FIG. 6B), the interruption of air flow through the bracket (78) stops the advancement of the bags, much like the first option, but the drive piston is always returned its home position after the bag enters the bracket (78). Control systems such as that shown at (76) and (80) are commercially available; an Allen-Air AVVCR $1\frac{1}{2}\times 1$ has produced good results.

The bag advancing friction gear (16) may be moved by a piston (96) between a position wherein it engages the bag advancing drive gear (15) and a position wherein the two gears are not in contact (as shown in FIG. 6B).

A bag-filling device according to the invention may be fabricated of any suitable materials. However, if the commodity to be placed in the bag consists of foodstuffs, any surfaces of the device which contact the food (e.g., the platform means) should be made of stainless steel, food grade urethane, or other materials that would not adversely affect the quality of the commodity.

As is described above, in use, the apparatus of the invention is loaded with bags by placing a series of the bags attached to a carrying tape (11) on top of the frame (1) and threading the tape down through the bag advancing means (12). The tape is then advanced to position the first bag on the frame below the cuffing arms (as shown in FIG. 2A). Once the bags have been loaded, the apparatus is ready to perform the bagging process.

Figure 7:
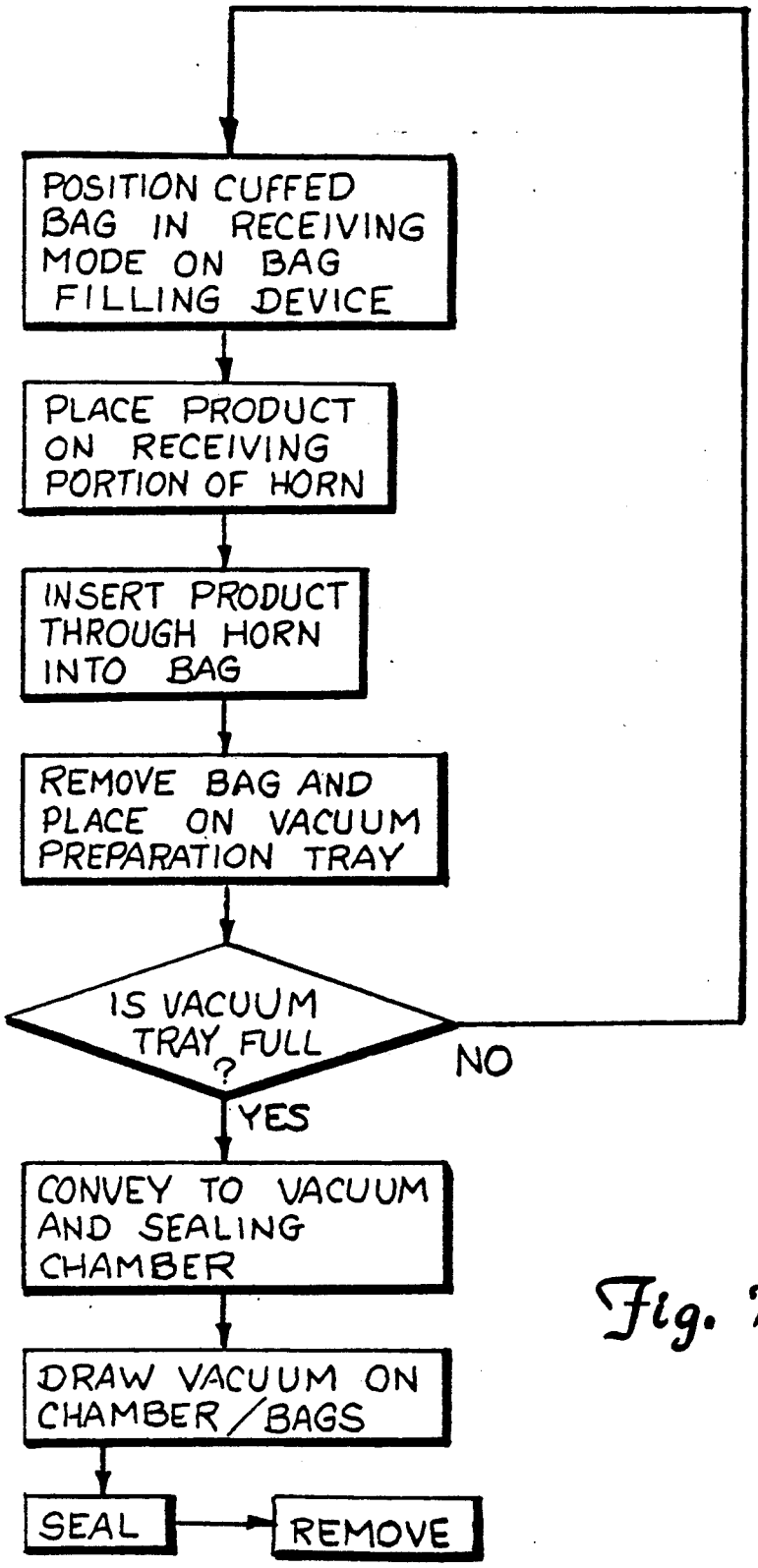
FIG. 7 is a flow chart showing the general method of filling a bag with a product and sealing it in accordance with the invention.
Figure 8:
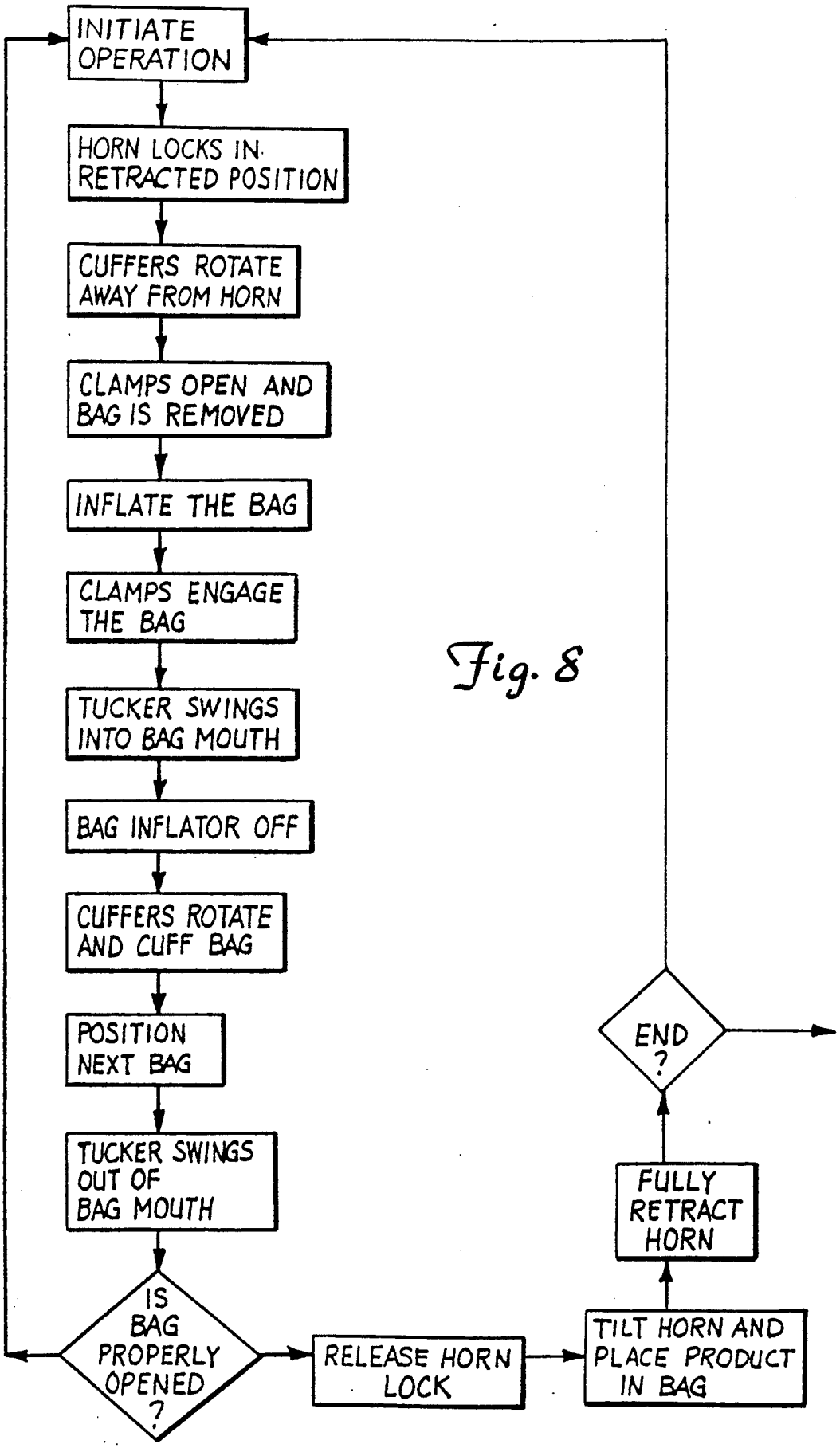
FIG. 8 is a flow chart showing in detail a method of filling a bag with a product according to the invention.

FIGS. 7 and 8 are flow charts which generally depict the process of bagging a commodity according to the invention. FIG. 7 provides a brief overview of the entire process, including sealing of the bag, while FIG. 8 provides a more detailed depiction of the bagging operation. Referring to FIG. 7, a bag (5) is first removed from the carrying tape and positioned by the cuffing arms (20) for receiving the product; the cuffing arms simultaneously form a cuff (6) on the bag. The product may then be placed on the horn (3) and formed into the desired shape if necessary. In practice the commodity forming operation and the bag positioning operation may occur simultaneously. Once the product is in its desired shape, the horn may be tilted forward (assuming the no-bag sensor has confirmed the presence of a bag) and the product is inserted into the bag. The horn is then returned to its initial position and the bag is removed from the cuffing arms and readied for the sealing operation, preferably vacuum heat sealing.

Vacuum heat sealing is preferably carried out in a batch operation, although it may be done in a continuous fashion. If it is done in a batch operation, a number of filled bags are conveyed to the vacuum sealing chamber. First, a vacuum is drawn on the chamber to evacuate air from the bags, then the sealable region of the bag is heated to provide a heat seal. These vacuum heat sealed bags may then be removed for further processing, such as roasting.

FIG. 8 shows a preferred way of carrying out the bagging operation in greater detail. First, the operator depresses the cycle start button (72 in FIG. 6) to begin operation of the machine. If the horn (3) is in its fully retracted, substantially horizontal position, it is locked in place (by pressurization of air cylinder (55)) and the operation may continue. However, if the horn is not properly positioned, the sequence will be interrupted and nothing further will happen, indicating to the operator that the horn must be retracted before proceeding to depress the cycle start button again.

Once the horn (3) is locked in position, the cuffing arms (20) rotate away from the horn and toward the back of the frame, moving from the position shown in FIG. 2I to substantially the same configuration depicted in 2A. The retaining clamps then pivot away from engagement with their respective cuffing arms, releasing the filled bag (5); this bag is then removed and may undergo further processing, such as described above.

The next bag on the carrying tape (11) is then inflated by air from the bag inflating nozzle to lift a portion of the bag between the cuffing arms. The retaining clamps pivot toward their respective cuffing arms, pinning a portion of the bag adjacent its opening therebetween. Next, the tucker arm rotates into position such that its V-shaped portion is adjacent or slightly in the mouth of the bag, and the flow of air through the bag inflating nozzle then is terminated. The cuffing arms are then be rotated toward the horn, forming a cuff on the bag with assistance from the tucker arm in urging the bag over the tapered ends of the cuffer arms. At any desired point thereafter, the next bag may be brought into position for the next operating sequence. The tucker then swings out of the mouth of the bag and back to its initial position disposed away from the bag.

If the no-bag sensor indicates that no bag is present or that a bag has not opened properly, the horn will remain locked to prevent the inadvertent loss of product; the operator must start the sequence again to properly position a bag before proceeding. If the no-bag sensor indicates that a bag is cuffed and ready to be filled, however, the horn is unlocked so the operator may tilt it forward into the mouth of the bag. This tilting may be manually performed by the operator or may be moved via the platform positioning air cylinder (55 in FIG. 1). The product is then placed in the bag, such as by sliding it along the platform and through the funnel-shaped forward portion of the horn. The operator should then retract the horn to its initial position; this may be done either manually or mechanically. If more product is to be bagged, the cycle start button is again depressed, initiating the sequence again.

While a preferred embodiment of the present invention has been described, it should be understood that various changes, adaptations and modifications may be made therein without departing from the spirit of the invention and the scope of the appended claims.

What is claimed is:

1. A method of filling a bag having an opening therein with a commodity, without contaminating a sealable region of the bag adjacent the opening, comprising the steps of:

forming a cuff in the sealable region of the bag adjacent the opening;

arranging the commodity on a platform adjacent to the cuffed bag, the platform including funnel means defining a funnel-like opening being closely receivable in the cuffed bag opening; and inserting the funnel means into the bag opening and filling the bag with the commodity.

2. The method of claim 1 including the steps of uncuffing the bag and then heat sealing the uncontaminated sealable region of the bag.

3. An apparatus for filling a bag having an opening therein with a commodity, without contaminating a sealable region of the bag near its opening, comprising cuffing means for forming a cuff in the bag opening, and platform means associated with the cuffing means for supporting the commodity adjacent tot he cuffed bag and for facilitating insertion of the commodity into the bag.

4. The apparatus of claim 3 further comprising locking means for holding the platform means at a position disposed away from the opening of the bag.

5. The apparatus of claim 3 further including tucking means for spreading substantially opposite sides of the opening of the bag away from one another to assist in the formation of the cuff.

6. The apparatus of claim 3 wherein the cuffing means includes a pair of rotatable cuffing arms.

7. The apparatus of claim 6 wherein each cuffing arm includes clamp means for grasping and holding the bag adjacent the bag opening.

8. The apparatus of claim 7 including bag inflator means for supplying a stream of gas under pressure directed toward the bag opening, the gas acting to inflate the bag sufficiently to permit the clamp means to grasp and hold the bag.

9. The apparatus of claim 6 wherein each cuffing arm includes a generally hemi-cylindrical portion for forming the cuff and holding the bag in an open configuration for receiving the commodity.

10. The apparatus of claim 3 wherein the platform means is movable between a first position oriented to facilitate preparation of the commodity, and a second position oriented to facilitate insertion of the commodity into the bag.

11. The apparatus of claim 10 wherein the platform means, when in the second position, extends partially into the opening of the bag.

12. The apparatus of claim 11 wherein the platform means includes means defining a funnel-like opening being closely receivable in the mouth of the bag.

13. The apparatus of claim 3, further comprising a frame for supporting bags to be filled with the commodity, means for advancing the bags sequentially to a usable position, and bag detection means for determining when a bag is in the usable position, the bag detection means comprising an air supply jet, port means spaced from the supply jet for receiving a stream of air from the jet, and air stream detection means for detecting the reception of air stream from the air supply jet, the air supply and the port means being positioned so that a bag occludes the air stream when it is in the usable position.

14. The apparatus of claim 13 wherein the air supply jet is located to provide a generally vertically upwardly directed stream of air.

15. The apparatus of claim 4 further comprising a no-bag sensor for detecting when the cuffing means has properly formed a cuff in a bag, the no-bag sensor being operatively connected to the locking means to permit the platform to be moved toward the opening of the bag when a cuff has been properly formed.

16. An apparatus for filling a bag having an opening therein with a commodity, without contaminating a sealable region of the bag near its opening, comprising a frame, a pair of rotatable cuffing arms carried on the frame for forming a cuff in the bag opening, and tucking means for spreading substantially opposite sides of the mouth of the bag intermediate the cuffing arms during rotation of the cuffing arms to form the cuff.

17. The apparatus of claim 16 wherein each cuffing arm includes clamp means for grasping and holding a portion of the bag adjacent the bag opening.

18. The apparatus of claim 16 wherein the tucking means includes a generally V-shaped member rotatable from a first position disposed away from the bag opening to a second position wherein the point of the V extends into the opening of the bag intermediate the cuffing arms sufficiently to spread the bag as the cuffing arms rotate to form the cuff.

19. An apparatus for filling a bag having an opening therein with a commodity, without contaminating a sealable region of the bag near its opening, comprising:

cuffing means for forming a cuff in the bag opening, the cuffing means including a pair of rotatable cuffing arms, each cuffing arm including clamp means for grasping and holding a portion of the bag adjacent the bag mouth and a generally hemi-cylindrical portion for forming the cuff and holding the bag in an open configuration to receive the commodity;

bag inflator means for supplying a stream of gas under pressure directed toward the bag opening, the gas acting to inflate the bag sufficiently to permit the clamp means to grasp and hold the bag;

tucking means for spreading substantially opposite sides of the mouth of the bag away from one another to assist in the formation of the cuff, the tucking means including a generally V-shaped member rotatable from a first position disposed away from the bag opening to a second position wherein the point of the V extends into the opening of the bag intermediate the cuffing arms sufficiently to spread the bag as the cuffing arms rotate to form the cuff; and platform means for supporting the commodity adjacent to the cuffed bag and for facilitating insertion of the commodity into the bag, the platform means including means defining a funnel-like opening being closely receivable in the mouth of the bag, and being movable between a first position oriented to facilitate preparation of the commodity and a second position with a portion of the funnel-like opening extending partially into the opening of the bag to facilitate insertion of the commodity into the bag.

* * * * *